US006808428B1

(12) United States Patent
Korsunsky et al.

(10) Patent No.: US 6,808,428 B1
(45) Date of Patent: Oct. 26, 2004

(54) ELECTRICAL CONNECTOR WITH KEYING MEANS

(75) Inventors: Iosif R. Korsunsky, Harrisburg, PA (US); Chong Hun Yi, Mechanicsburg, PA (US); Richard B. Emenheiser, Mount Joy, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/437,864

(22) Filed: May 13, 2003

(51) Int. Cl.[7] ..... H01R 13/648

(52) U.S. Cl. ..... 439/680

(58) Field of Search ..... 439/680, 681, 439/610, 609, 607, 320

(56) References Cited

U.S. PATENT DOCUMENTS

| | | | | | |
|---|---|---|---|---|---|
| 4,854,895 | A | * | 8/1989 | Komatsu | 439/610 |
| 4,938,718 | A | * | 7/1990 | Guendel | 439/680 |
| 5,013,262 | A | * | 5/1991 | Shibano | 439/610 |
| 5,080,604 | A | | 1/1992 | Rider et al. | |
| 5,161,997 | A | * | 11/1992 | Defibaugh et al. | 439/532 |
| 6,066,003 | A | | 5/2000 | Chang | |

* cited by examiner

*Primary Examiner*—Ross Gushi
*Assistant Examiner*—Phuongchi Nguyen
(74) *Attorney, Agent, or Firm*—Wei Te Chung

(57) ABSTRACT

An electrical connector (1) for contacting with a complementary connector includes an insulative housing (2), a number of terminals (3) retained in the insulative housing and a shield (4) enclosing the insulative housing. The shield includes a keying means (416, 418,) extending outwardly from a surface thereof for engaging with the complementary connector.

6 Claims, 6 Drawing Sheets

ELECTRICAL CONNECTOR WITH KEYING MEANS

BACKGROUND OF THE INVENTION

1. Field of the Invention

The present invention relates to an electrical connector, and particularly to an electrical connector with keying means for securing an exact engagement between the electrical connector and a complementary connector.

2. Description of Prior Art

Electrical connector assembly with mating plug and receptacle connectors is widely used for transmitting signals in electronic devices. The plug and receptacle connectors each include an insulative housing, a plurality of terminals received in the insulative housing and a shell enclosing the insulative housing for shielding. However, in assembly, the plug connector is possible to be wrongly inserted into the receptacle connector thereby adversely affecting signals transmitting therebetween or damaging the plug or receptacle connector. Therefore, a keying means should be provided for guiding an engagement between the plug and receptacle connectors.

U.S. Pat. No. 6,066,003 (the '003 patent) discloses a conventional electrical connector with a keying means. Referring to FIG. 8 of the '003 patent, a blind mate connector includes a housing (6), a shield (5) enclosing the housing and a plurality of terminals (7) received in the housing. The shield includes a flange (50) and a shroud (51) projecting forwardly from the flange. The shroud includes four discontinuous guiding surfaces (511) extending in four directions therefrom for guiding an insertion of a complementary connector. However, the guiding surface only can facilitate the insertion of the complementary connector, but cannot ensure an exact engagement between the blind mate connector and the complementary connector for a wrong insertion.

U.S. Pat. No. 5,080,604 (the '604 patent) discloses another conventional connector assembly with keying means for guiding an engagement between a cable connector and a mating header. Referring to FIG. 1 of the '604 patent, a connector assembly (10) includes a cable connector (20) and a mating header (100). The cable connector includes a receptacle type housing (22) and a cover (70) assembled to the housing. The housing includes a polarizing key (42) at a front end of an inner surface thereof. The header has a housing (102) with a conical-shaped leading end (132) and a key-way (134) defined on an outer surface thereof. In assembly, the header is assembled to the cable connector with the leading end of the housing of the header engageably received in the housing of the cable connector for guiding insertion of the header. In addition, the polarizing key of the cable connector is engageably received in the key way of the header for guiding further insertion of the header and securing a true electrical connecting between the cable connector and the header. However, the key is formed by plastic and will wear out after many insertions and withdrawals, and in turn, the engagement between the cable connector and the header will be affected. Thus, the key cannot ensure an exact engagement between the cable connector and the header for a wrong insertion.

Hence, an improved electrical connector with improved keying means is required to overcome the disadvantages of the conventional connector.

SUMMARY OF THE INVENTION

Accordingly, an object of the present invention is to provide an electrical connector with keying means for securing an exact engagement between the electrical connector and a complementary connector.

In order to achieve the object set forth, an electrical connector in accordance with the present invention includes an insulative housing, a plurality of terminals retained in the insulative housing and a shield assembled to the insulative housing. The insulative housing includes a dielectric base and a tongue plate projecting from the dielectric base. The shield includes a base plate attached to dielectric base and a shroud enclosing the tongue plate. The shroud includes a keying means projecting outwardly from an outer surface thereof for engaging with the complementary connector thereby securing an exact engagement between the electrical connector and the complementary connector.

Other objects, advantages and novel features of the invention will become more apparent from the following detailed description when taken in conjunction with the accompanying drawings.

DETAILED DESCRIPTION OF PREFERRED EMBODIMENTS

Figure 1:
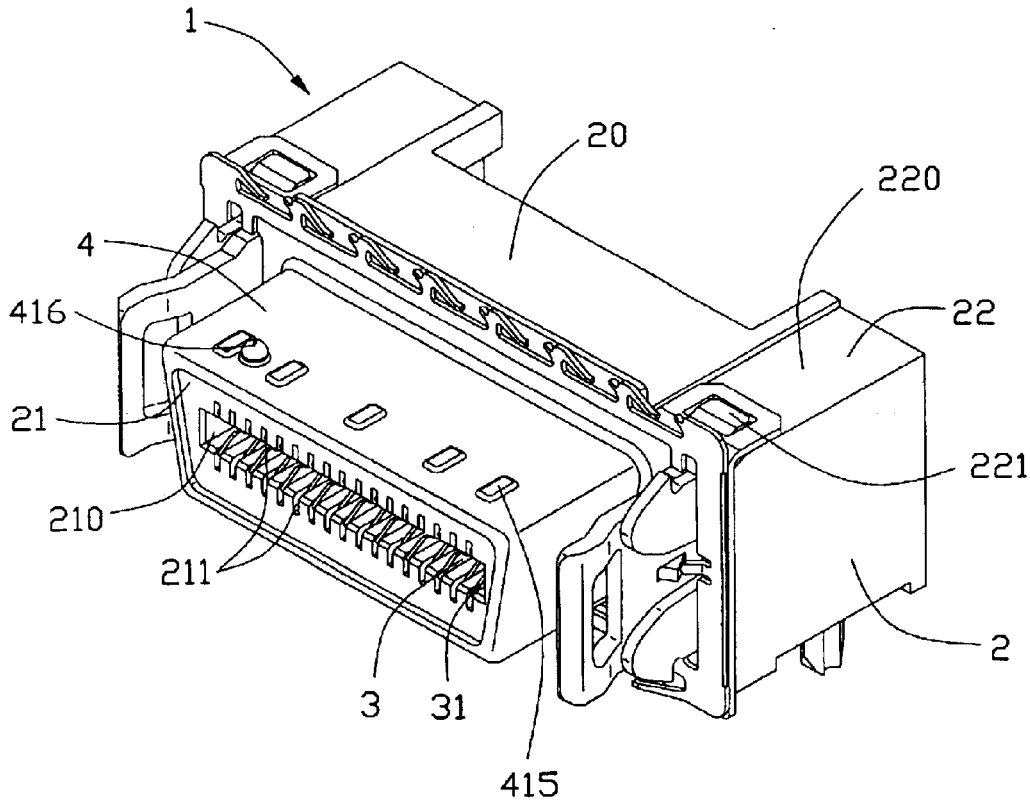
FIG. 1 is a top, front and right perspective view of an electrical connector in accordance with a first embodiment of the present invention.

Reference will now be made to the drawing figures to describe the present invention in detail.

Figure 2:
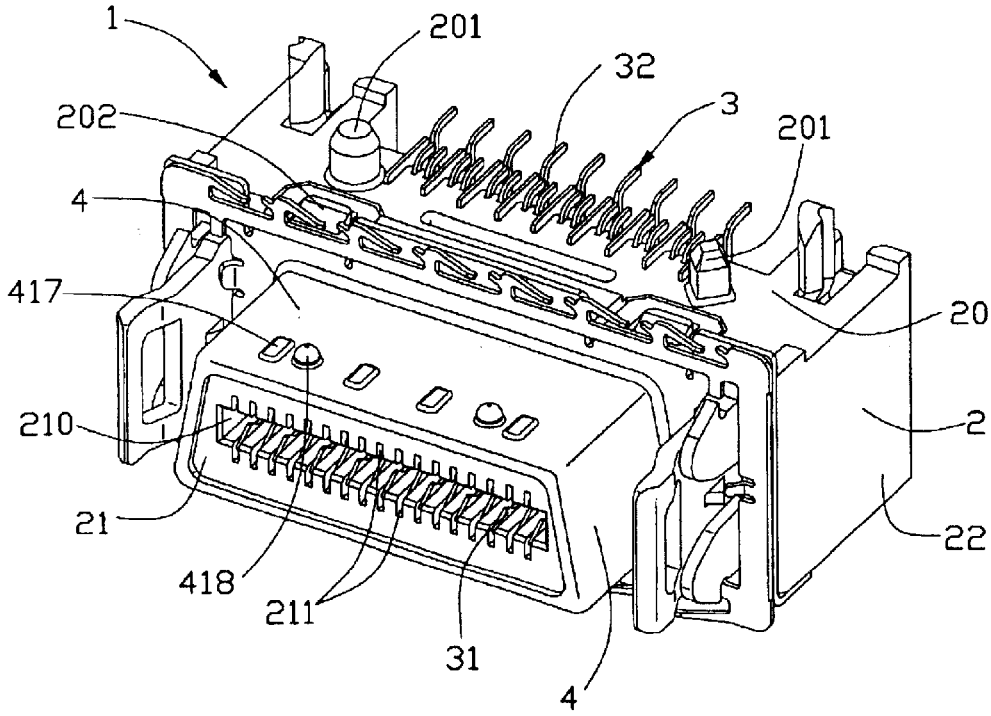
FIG. 2 is a bottom, front and left perspective view of the electrical connector of FIG. 1.

Referring to FIGS. 1 and 2, an electrical connector 1 in accordance with a first embodiment of the present invention is shown. The electrical connector 1 includes an insulative housing 2, a shield 4 for enclosing the insulative housing 2 and a plurality of terminals 3 received in the insulative housing 2.

The insulative housing 2 includes a substantially rectangular dielectric base 20, a rectangular tongue plate 21 extending forwardly from a front surface of the dielectric base 20 and two beams 22 at opposite transverse ends thereof. The dielectric base 20 includes a pair of guiding poles 201 extending downwardly from a bottom surface 200 of opposite ends thereof for engageably received in a mating Printed Circuit Board (PCB) (not shown) on which the electrical connector 1 is mounted. In addition, the base 20 includes a pair of lower bulges 202 extending downwardly from the bottom surface 200. The two guiding poles 201 respectively have different configurations. One guiding pole 201 is columnar-shaped, and the other has a prism-shape. The beams 22 each include an upper bulge 221 extending upwardly from a top surface 220 thereof. The tongue plate 21 defines a receiving space 210 therein for receiving a mating portion of a complementary connector (not shown) and a plurality of upper and lower passageways 211 communicating with the receiving space 210.

The terminals 3 each include a contacting portion 31 at a front end thereof and a soldering portion 32 at a rear end thereof. The contacting portions 31 are respectively received in corresponding receiving passageways 211 for electrically connecting with contacts of the complementary connector. The soldering portions 32 are adapted for soldering on the mating PCB.

Figure 3:
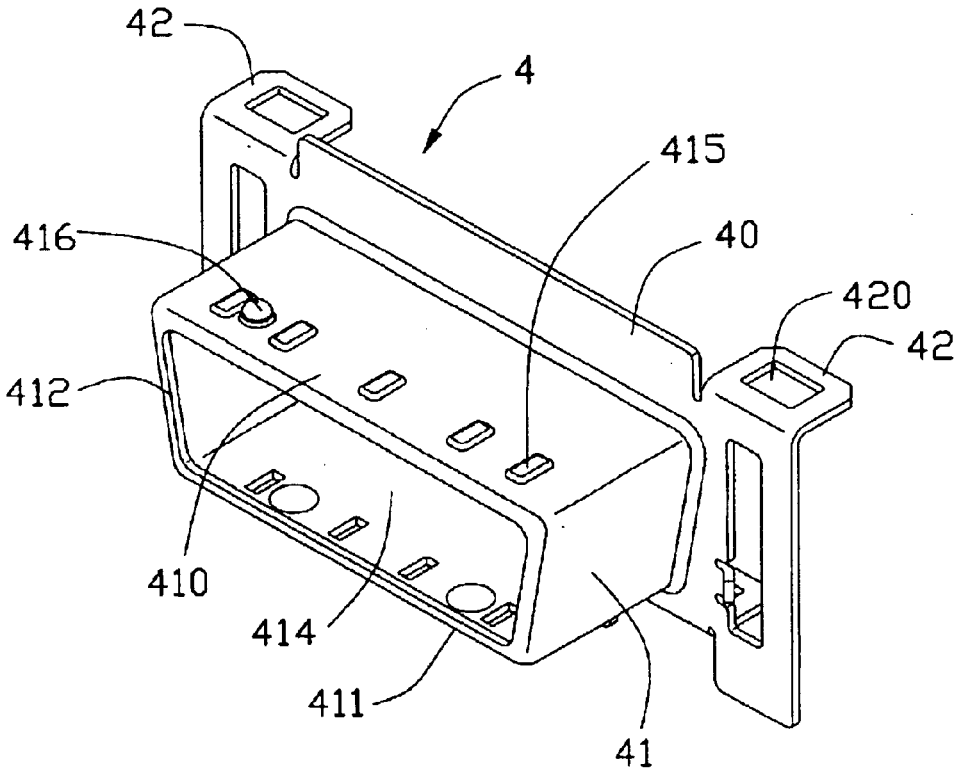
FIG. 3 is a top, front and right perspective view of a shield of the electrical connector of FIG. 1.
Figure 4:
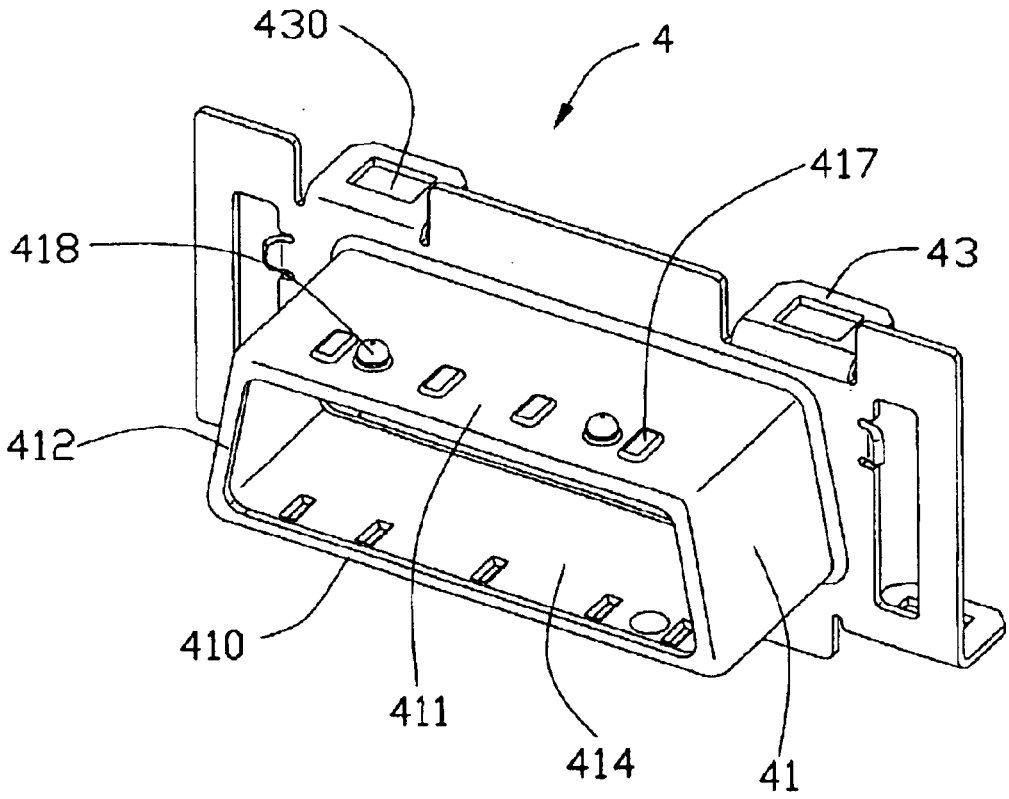
FIG. 4 is a bottom, front and left perspective view of the shield of the electrical connector of FIG. 1.

Referring to FIGS. 3–4, in conjunction with FIGS. 1–2, the shield 4 includes a base plate 40, a shroud 41 projecting forwardly from the base plate 40, a pair of upper retaining plates 42 extending rearwardly from a top side thereof and a pair of lower retaining plates 43 extending rearwardly from a bottom side thereof. The upper (lower) retaining plates 42 (43) each define a locking opening 420 (430) for engageably receiving a corresponding upper (lower) bulge (202) 221.

The shroud 41 includes a top wall 410, an opposite bottom wall 411 and a pair of opposite side walls 412 connecting with the top and bottom walls 411, 412. The top, bottom and side walls 410, 411, 412 together define a receiving room 414 for receiving the tongue plate 21. The top wall 410 includes five rectangular protrusions 415 extending upwardly therefrom and a spherical calotte 416 extending upwardly therefrom. Similarity, the bottom wall 11 includes four rectangular protrusions 417 extending downwardly therefrom and a pair of spherical calottes 418 extending downwardly therefrom.

In assembly, the terminals 3 are inserted into the insulative housing 2 with the contacting portions 31 respectively received corresponding receiving passageways 211 and projecting into the receiving space 210 for electrically connecting with the contacts of the complementary connector. The soldering portions 32 are arranged below the bottom surface 200 of the insulative housing 2 for soldering on the mating PCB. The shield 3 is assembled to the insulative housing 2 along a front-to-rear direction with the shroud 41 enclosing the tongue plate 21. The upper (lower) bulges 221 (202) are respectively engagably received in the locking openings 420 (430) of the upper (lower) plates 42 (43) for securely retaining the shield 4 on the insulative housing 2. While the complementary connector is mated to the electrical connector 1, the spherical calottes 416, 418 are engageably received in corresponding keying ways of the complementary connector to guide an insertion of the complementary connector and to secure an exact engagement between the electrical connector 1 and the complementary connector. In addition, the protrusions 415, 417 engage with the complementary connector to ensure a secured connection between the electrical connector 1 and the complementary connector. While the complementary connector is wrongly inserted into the electrical connector 1, the spherical calottes 416, 418 are not engageably received in the complementary connector thereby preventing the complementary connector from electrically connecting with the electrical connector 1 and avoiding damage of the complementary connector and the electrical connector 1.

Figure 5:
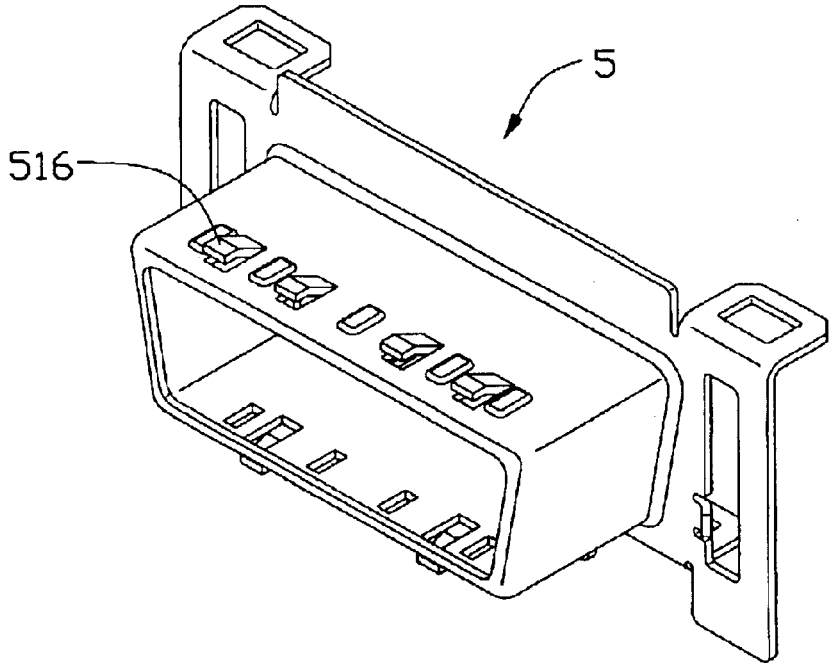
FIG. 5 is a top, front and right perspective view of a shield in accordance with a second embodiment of the present invention.
Figure 6:
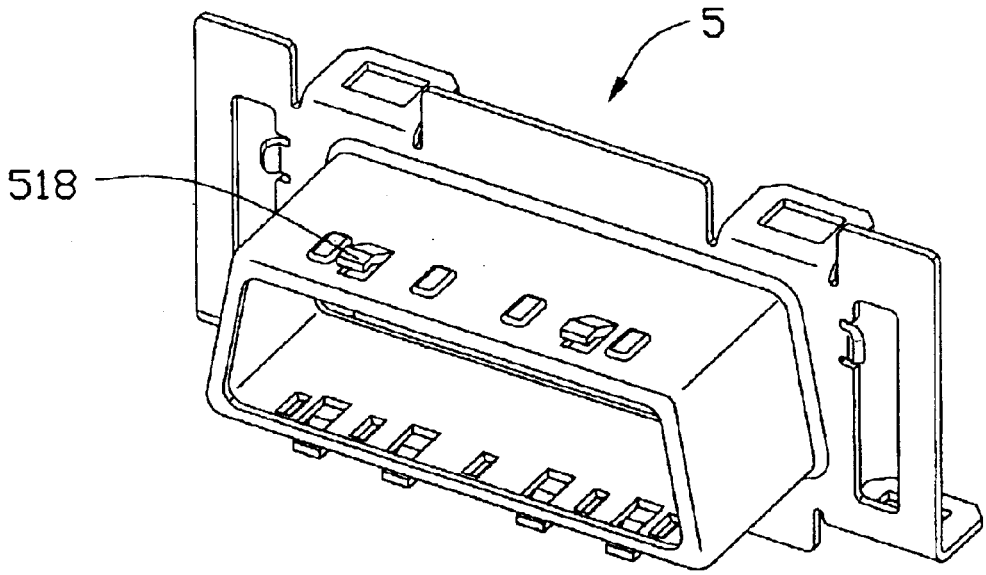
FIG. 6 is a bottom, front and right perspective view of the shield of FIG. 5.

FIGS. 5 and 6 show a design in accordance with a second embodiment of the present invention. In this embodiment, the configurations of the housing and the terminals are similar to those of the first embodiment, so descriptions thereabout are omitted herefrom. A shield 5 in accordance with the second embodiment comprises a plurality of lances 516, 518 instead of calottes as keying means extending outwardly from the shroud thereof. The other parts of the shield 5 are similar to that of the first embodiment, so they are not described herein.

It is apparent that the two embodiments may be combined together. For example, in the first embodiment, the shield may have some lances instead of some of the spherical calottes. In addition, in the second embodiment, the shield also may have some spherical calottes in place of some of the lances.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for contacting with a complementary connector, comprising:

an insulative housing;

a plurality of terminals in the insulative housing; and an island-like and unsymmetrical shield enclosing the insulative housing and comprising a keying means projecting outwardly from an outer surface thereof and adapted for being straightly snugly received in a corresponding keyway of the complementary connectors;

wherein the keying means comprises a spherical calotte projecting outwardly from the shield;

wherein the shield comprises a protrusion extending outwardly therefrom and adapted for engaging with the complementary connector;

wherein the insulative housing comprises a tongue plate extending therefrom adapted for engaging with the complementary connector;

wherein the insulative housing comprises a bulge extending outwardly therefrom and the shield comprises an opening for engageably receiving the bulge.

2. The electrical connector as described in claim 1, wherein the shield comprises a shroud extending therefrom for enclosing the tongue plate.

3. The electrical connector as described in claim 2, wherein the keying means is formed on the shroud.

4. The electrical connector as described in claim 1, wherein the shield comprises at least one protrusion adjacent to the keying means for enhancing mechanical engagement with the complementary connector.

5. The electrical connector as described in claim 4, wherein said at least one protrusion is horizontally aligned with the keying means.

6. An electrical connector assembly comprising:

an insulative housing having a plurality of terms therein, said housing including an island portion forwardly integrally therefrom;

a unit metallic shield enclosing said housing, said shield including a shroud enclosing said island portion circumferentially, wherein said shroud includes a plurality of outwardly extending keys and a plurality of protrusions on an exterior surface thereof, said keys being dimensioned to be large enough to be slidably snugly received in corresponding keyways of a complementary connector along a front-to-back direction of said housing so as to assure correct orientation during mating, and said protrusions being dimensioned to be lower than the keys and to assure secure connection between the shroud and the complementary connectors;

wherein said keys ate asymmetrically arranged along a periphery of said shroud, wherein the keying means comprises a lance extending outwardly from the shield;

wherein the shield comprises a protrusion extending outwardly therefrom and adapted for engaging with the complementary connector;

wherein the insulative housing comprises a tongue plate extending therefrom adapted for engaging with the complementary connector;

wherein the insulative housing comprises a bulge extending outwardly therefrom and the shield comprises an opening for engageably receiving the bulge.

* * * * *